US005100413A

United States Patent [19]

Doley

[11] Patent Number: 5,100,413

[45] Date of Patent: Mar. 31, 1992

[54] ROTARY HEAD MULTI-TWEEZER HAIR REMOVAL DEVICE

[76] Inventor: Moshe Dolev, 22 Yehiam Street, Ramat Hasharon, Israel

[21] Appl. No.: 664,760

[22] Filed: Mar. 5, 1991

[51] Int. Cl.[5] ..... A61B 19/00

[52] U.S. Cl. ..... 606/133; 606/131

[58] Field of Search ..... 606/36, 43, 131, 133

[56] References Cited

U.S. PATENT DOCUMENTS

| | | | |
|---|---|---|---|
| 1,923,415 | 5/1890 | Bingham . | |
| 2,496,223 | 1/1950 | Lanzisera | 606/133 |
| 2,900,661 | 8/1959 | Schnell | 606/133 |
| 4,079,741 | 3/1978 | Daar et al. | 606/133 |
| 4,524,772 | 6/1985 | Daar et al. | 606/133 |
| 4,575,902 | 3/1986 | Alazet | 606/133 |
| 4,726,375 | 2/1988 | Gross et al. | 606/133 |
| 4,807,624 | 2/1989 | Gross et al. | 606/133 |
| 4,917,678 | 4/1990 | Locke et al. | 606/133 |
| 4,935,024 | 6/1990 | Doley | 606/133 |
| 5,032,126 | 7/1991 | Cleyet et al. | 606/133 |

FOREIGN PATENT DOCUMENTS

| | | | |
|---|---|---|---|
| 0147285 | 7/1985 | European Pat. Off. | 606/133 |

*Primary Examiner*—Stephen C. Pellegrino
*Assistant Examiner*—Glenn K. Dawson
*Attorney, Agent, or Firm*—Edward Langer

[57] ABSTRACT

A hair removal device having a plurality of tweezers mounted on a rotary head and arranged to open and close during rotation, to trap and pluck skin hair over a relatively wide area. In a preferred embodiment, the rotary head multi-tweezer design is provided as a hand-held, motor-powered depilatory device having a rotor formed with radially extending support channels. A plurality of tweezers are mounted on each support channel, each tweezer comprising a pivotable element and a fixed element, which are operated by a slidable actuator. As the rotary head rotates about a shaft, the slidable actuator moves in accordance with the shape of a cam in synchronous fashion, causing it to slide radially inward and outward along the support channel, and forcing the tweezers open and closed. When passed over the skin, the tweezers on the rotary head operate in two-sided fashion by opening and closing over a wide area, and skin hair in this area is grasped and plucked as the tweezers close, performing the hair removal function.

11 Claims, 2 Drawing Sheets

ROTARY HEAD MULTI-TWEEZER HAIR REMOVAL DEVICE

FIELD OF THE INVENTION

The present invention relates to motorized depilatory devices for removing unwanted skin hair, and more particularly, to a new and useful hair removal device having a rotary head containing multiple-tweezer elements arranged to pluck skin hair.

BACKGROUND OF THE INVENTION

The prior art of motor-powered depilatory devices using springs for removing skin hair is based on a well-known operational concept of an early mechanical device disclosed in Swiss Pat. 268,696 to Fischer. This hand-operated device uses an arched coil spring to trap and pluck hair between its loops as it rolls over the skin.

Other hand-operated coil spring designs are disclosed in the group including Swiss Patent 179,261 to Macioce, U.S. Pat. No. 2,458,911 to Kerr, U.S. Pat. No. 2,486,616 to Schubiger, British Patent 203,970 to Davis, U.S. Pat. No. 1,743,590 to Binz, and U.S. Pat. No. 1,232,617 to Shipp. There vary in the mechanical arrangements for stretching the spring and engaging the hair between coil spring loops before it is trapped upon closure of the stretched spring.

U.S. Pat. No. 4,079,741 to Daar et al. discloses a single tension spring disposed parallel to the skin and arranged to be stretched and compressed so as to pluck hairs trapped between its loops. The overall design is complicated and expensive.

An arched helical spring provided with high speed rotational motion for opening and closing the loops is provided in U.S. Pat. No. 4,524,772 to Daar et al. U.S. Pat. Nos. 4,726,375 and 4,807,624 to Gross et al. disclose a rubber hair-plucking element with partially circumferential slits or rubber discs for trapping and plucking skin hair.

These patents are all based on the concept of rotating the coil spring or slits near the skin to enable hairs to become trapped, but they have a tendency to "wind" while slowly developing sufficient hair-pulling tension, and this creates additional discomfort in use of these devices. In addition, with the spring designs, the contact with the hair is point-like, increasing the likelihood that hair will be pinched and torn, but not plucked.

U.S. Pat. No. 1,923,415 to Bingham discloses a plurality of rotatable discs arranged to be bent one or more times toward each other at a point during each revolution, causing them to pluck bird feathers. This design is not applicable to hair plucking as it is complicated, expensive to manufacture, and inefficient.

French Patent 1,017,490 to Bachofen discloses a bird feather plucking device using a set of rotatable discs, each disc having a curved surface area, and being arranged to be bent toward one another at a point during each revolution. Again, this is a complicated, and inefficient design.

Another device for removing bird feathers is disclosed in French Patent 1,123,971 to Jadoul, based on a plurality of rotatable discs arranged to be bent toward one another at a point during each revolution. Again, this is an inefficient design.

Still another poultry feather plucking device is disclosed in U.S. Pat. No. 2,496,223 to Lanzisera, based on the use of a helical spring which rotates on one side of a grid, such that feathers which project through the grid are grasped between loops of the spring and are plucked. This design allows only one plucking action per revolution of the spring, besides being complicated and expensive to manufacture.

In general, the spring and disc designs available for feather plucking are not applicable to hair plucking, due to their size, complicated construction and inefficient operation.

Another disc design is disclosed in U.S. Pat. No. 2,900,661 to Schnell, wherein a pair of discs rotate at a large angle to each other and converge at a contact point whereat hairs are plucked. The large size of this design makes it inefficient since only a few discs can be located within a given space, and the inflexible discs tend to cut the hair, not pluck it.

In U.S. Pat. No. 4,575,902 to Alazet, there is disclosed a depilatory device comprising a series of adjacent, closely-spaced hair-plucking discs driven by an electric motor. In one embodiment, the discs are periodically deformed during rotation so as to trap hair between them as they are pressed together. This design very similar to the Jadoul patent described earlier, and is similarly inefficient since the discs close only once per rotation, limiting plucking action to a short time interval. Also, it is not feasible to achieve closure of the large number of discs by deformation since the cumulative spacing is too great.

In the second embodiment described in the Alazet patent, a pair of movable hair-gripping combs are positioned between adjacent discs to provide hair plucking when they are applied against the discs. Each of the combs is movable on its own shaft and its area covers only an angular sector of the disc against which it is applied, so that only a partial disc area is effective for plucking of hair. The disclosure suggests that more than two combs may be used to increase the effective disc area used for plucking, but this would require additional movable shafts and cams, which cannot be achieved within a limited space without further complicating the construction and operation.

A design similar to Alazet is marketed by Calor under the tradename "Caresse" and uses two cam-operated shafts for moving a set of movable tweezers against a set of fixed discs in one direction only, once per revolution. Another similar design is marketed by Braun under the tradename "Silkappeal" and has a plurality of moving segments closing against one another once per revolution. Both are complicated and inefficient designs.

In my previous U.S. Pat. No. 4,935,024 there is disclosed a novel coupled-disc element which reduces the "winding" phenomenon of previous designs, while reducing the painful sensation.

It would therefore be desirable to provide a power-driven depilatory device which provides efficient hair removal by increasing the number of hair plucking operations using a simplified construction.

It would also be desirable to provide a depilatory device which is simple in construction for cost-effective production, while durable in use.

Additionally, it would be desirable to provide a depilatory device which minimizes pain in relation to prior art spring designs and achieves greater efficiency with respect to prior art discs designs, while being simple to manufacture, use and maintain.

SUMMARY OF THE INVENTION

Accordingly, it is a principal object of the invention to provide a hair removal device having a multiple-tweezer element mounted on a rotary head and arranged to pluck skin hair.

In accordance with a preferred embodiment of the present invention, there is provided a rotary head multiple-tweezer depilatory device comprising in combination:

a housing;

rotary head means comprising a plurality of support channels extending radially, each channel having mounted therein a plurality of tweezers each comprising a fixed element and a pivotably movable element, actuator means slidably seated in each of said channels engaging said pivotably movable elements for operating said tweezers, said rotary head means being arranged to rotate about a shaft seated within said housing substantially perpendicular to an area of skin from which hair is to be removed;

a motor disposed in said housing and being arranged to drive said rotary head means about said shaft; and cam means arranged to cause repetitive, push-pull radial sliding motion of said actuator means synchrounous with rotation of said rotary head means about said shaft, such that when placed near the skin, rotation of said rotary head means about said shaft causes each of said tweezers to alternately open and close, trapping skin hair therein when opened and plucking it when closed.

In the preferred embodiment, the rotary head multi-tweezer design is provided as a hand-held, motor-powered depilatory device having a rotor formed with a plurality of support channels for supporting a plurality of tweezer elements. Each of the tweezer elements is arranged as a vertically extending, pivotable element and a fixed element. Each pivotable element engages a radially slidable actuator seated in the support channel, which is operable to open and close the pivotable element against the fixed element. A cam follower associated with each slidable actuator engages a groove formed in a cam which is fixed over the support channels. As the rotary head rotates, the cam develops the lateral push-pull radial sliding motion of the slidable actuator in synchronous fashion, causing the tweezers to open and close.

When passed over the skin, the elements of the multiple tweezers, which are seated in the support channels of the rotary head, open and close, and the skin hair is grasped and plucked, thus performing the hair removal function.

The design of the rotary head means is such as to aid in combing the hairs to be plucked during rotation, minimizing the tendency of hairs to slip from between the tweezers, by guiding them between the tweezers so that they are plucked.

The inventive rotary head multi-tweezer design has many advantages over the prior art, including simple construction, allowing for cost-effective production, and ease of use.

Other features and advantages of the invention will become apparent from the drawings and the description contained hereinbelow.

BRIEF DESCRIPTION OF THE DRAWINGS

For a better understanding of the invention with regard to the embodiments thereof, reference is made to the accompanying drawings, in which like numerals designate corresponding elements or sections throughout and in which.

DETAILED DESCRIPTION OF THE PREFERRED EMBODIMENTS

Figure 2:
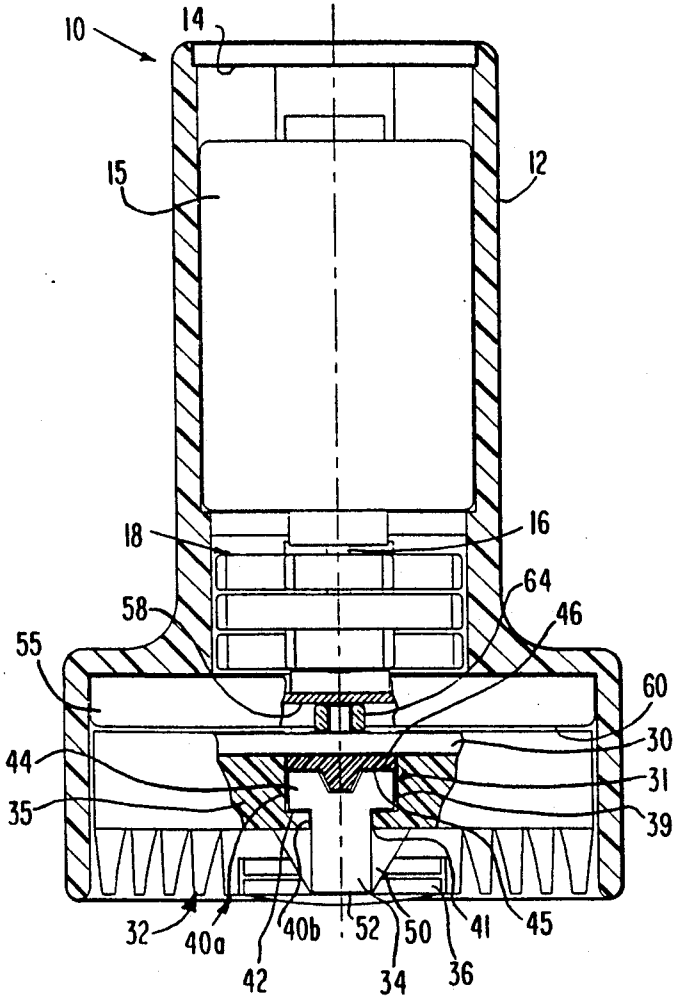
FIG. 2 is a cross-sectional side view of the rotary head multi-tweezer hair removal device of FIG. 1.
Figure 1:
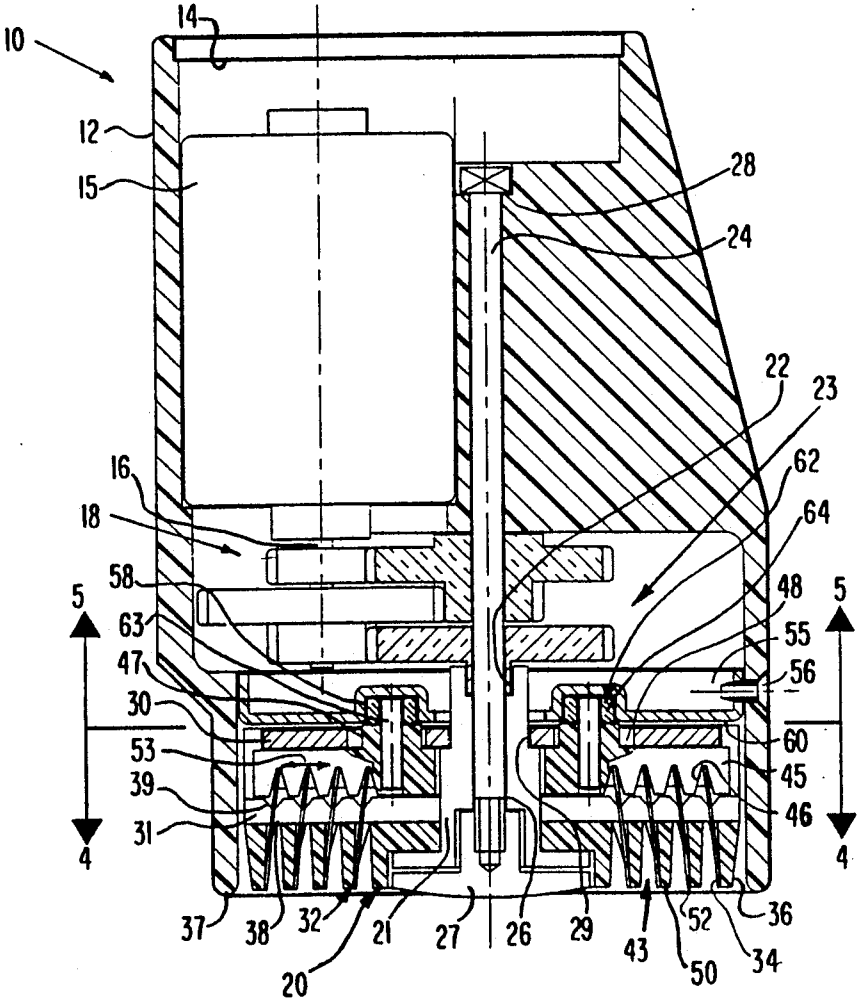
FIG. 1 is a cross-sectional elevation view of a preferred embodiment of a rotary head multi-tweezer hair removal device constructed and operated in accordance with the principles of the present invention.

Referring now to FIGS. 1-2, there are shown cross-sectional elevation and side views of a preferred embodiment of a rotary head multi-tweezer hair removal device 10 constructed and operated in accordance with the principles of the present invention. Device 10 comprises a housing 12, a motor compartment 14 and a miniature electric motor 15 disposed therein. A drive shaft 16 of motor 15 has mounted thereon a set of drive gears 18, which provide rotational power to a rotary head 20 mounted so as to face opposite the skin from which hair is to be plucked.

Rotary head 20 is shaped as a disc which has seated at its center a hub 21, which is coupled at its upper end via coupling 22 to a set of gears 23 which mesh with drive gears 18 mounted on drive shaft 16 of motor 15, providing a set of reduction gears. Rotary head 20 rotates about a shaft 24 which extends through a central borehole 26 of hub 21. A retaining nut 27 retains hub 21 on shaft 24, and the upper end of shaft 24 is seated firmly in a hole 28, which is formed in housing 12.

Hub 21 is shaped to fit within a coupling 29 (FIG. 4), which is integrally formed within a cover plate 30 coupled to rotary head 20 with screws 66. Rotary power is transferred from hub 21 to rotary head 20 via coupling 29 and screws 66. A plurality of radially extending channels 31 are formed within rotary head 20, with each of channels 31 supporting a plurality of tweezers 32. Each tweezer 32 comprises a pivotable element 34 and a fixed element 36. Fixed elements 36 are integrally formed with the surrounding walls 35 of each of support channels 31 and have a tapered shape which extends vertically downward therefrom toward the housing 12 open end 37. A set of concentric slots 38 is defined between fixed elements 36.

Support channel 31 is formed with notches 39 extending perpendicular to its length, and with a radially extending stepped groove formed by upper groove **40*a* and lower groove 40*b*. A pivotable element 34 of tweezer 32 is seated in channel 31 in each of notches 39. An opening 41 is formed through the bottom of lower groove 40*b* at each intersection with slots 38 (FIG. 2), through which pivotable element 34 vertically passes. A shoulder 42 of pivotable element 34 is pivotably supported in notch 39 of groove 40*a*, with each notch 39 located centrally at opening 41**.

Once seated in channel 31, pivotable element 34 is disposed between a pair of oppositely-facing fixed elements 36. This design enables two-sided operation of tweezers 32, as further described herein. A plurality of spaces 43 are defined between pivotable elements 34 and fixed elements 36.

The upper end of each of pivotable elements 34 is integrally formed with a pair of flanges 44 (FIG. 2). An actuator 45, formed with a set of notches 46, is seated over pivotable elements 34 so as to be slidable radially within upper groove 40*a* of channel 31. The tops of flanges 44 are pivotally seated within notches 46 of actuator 45. Cover plate 30 is seated over slidable actuator 45 and maintains it within support channel 31, while upper groove 40*a* guides radial movement of slidable actuator 45 therewithin. When slidable actuator 45 slides radially in upper groove 40*a*, its shoulder 47 moves within a slot 48 formed within cover plate 30.

Each of fixed elements 36 comprises a planar surface, with a lower edge 50 against which the lower edge 52 of pivotable element 34 moves when a tweezer-like hair plucking operation is provided. Sliding motion of slidable actuator 45 in the direction of arrow 53 causes lower edges 52 of each of pivotable elements 34 to "flip" and come into contact with lower edges 50 of each of fixed elements 36. Since each of pivotable elements 34 is disposed between a pair of fixed elements 36, two-sided tweezer 32 operation is achieved by contact of lower edges 52 with lower edges 50 on either of the oppositely-facing fixed elements 36.

A cam 55 shaped as a circular plate is centrally seated with respect to shaft 24, and is fixedly attached to housing 12 by mounting screws 56, only one of which is shown. Cam 55 is provided with a channel-shaped groove 58 formed in its underside 60. Extending vertically from each of slidable actuators 45 is a cam follower 62 comprising pin 63 and roller 64, which engages groove 58 of cam 55. The contour of groove 58 (FIG. 5) governs the motion of cam follower 62 and the radial movement of slidable actuator 45 within upper groove 40*a* of support channel 31.

In the cross-sectional side view of FIG. 2, more details of tweezer 32 assembly are shown (in the partial cutaway of the drawing), including the seating of pivotable element 34 within support channel 31 and notches 39. Pivotable element 34 passes through opening 41 formed in support channel 31, and is seated such that lower edges 52 are opposite lower edges 50 of fixed element 36. Flanges 44 of each movable element 34 are shaped to engage notch 46 formed in slidable actuator 45, to maintain a secure mechanical connection for operating tweezers 32.

Figure 3:
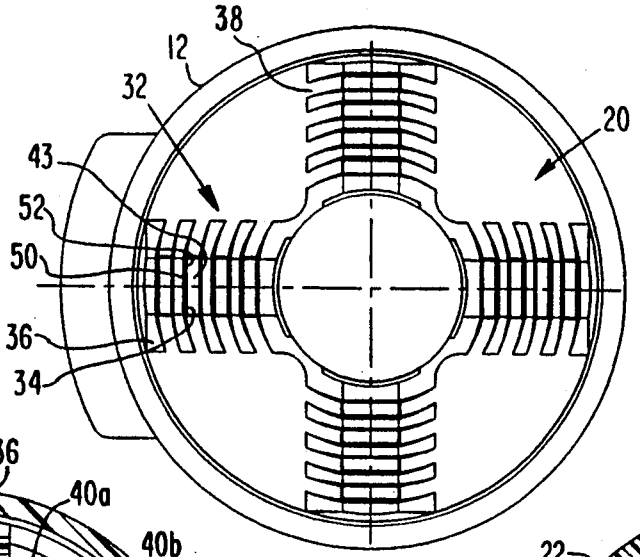
FIG. 3 is a bottom view of the rotary head multi-tweezer hair removal device of FIG. 1.
Figure 4:
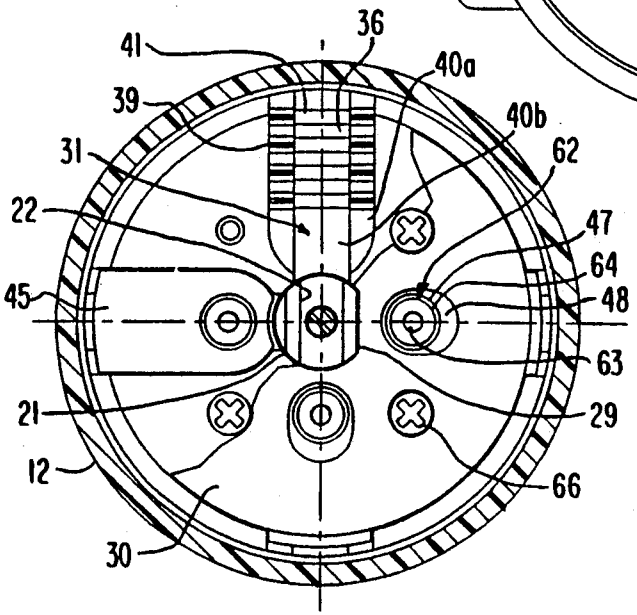
FIG. 4 is a cross-sectional view of the hair removal device taken along section lines IV—IV of FIG. 1.

In FIG. 3, there is shown a bottom view of the rotary head multi-tweezer hair removal device of FIG. 1, revealing further construction details of tweezer elements 32. FIG. 4 shows a cross-sectional top view of the hair removal device taken along section lines IV—IV of FIG. 1, revealing the construction of support channel 31, the top edge of fixed elements 36, notches 39, grooves 40*a*, 40*b*, openings 41, and screws 66.

In operation, when motor 15 is powered by batteries or supplied with power by a conventional cord and plug connection (not shown), drive shaft 16 transfers rotational power to rotary head 20 via reduction drive gears 18 and 23. Rotation of rotary head 20 causes support channels 31 to rotate with respect to cam 55, which remains fixed in position. During this rotation, the engagement of cam follower 62 in cam 55 forces it to ride along the contour of groove 58, and shoulder 47 moves within slot 48. Thus, slidable actuator 45 is forced to slide radially outward and inward in push-pull fashion within upper groove 40*a*, synchronous with rotary head 20 rotation, opening and closing tweezers 32 and providing a tweezer-like hair plucking operation.

Figure 5:
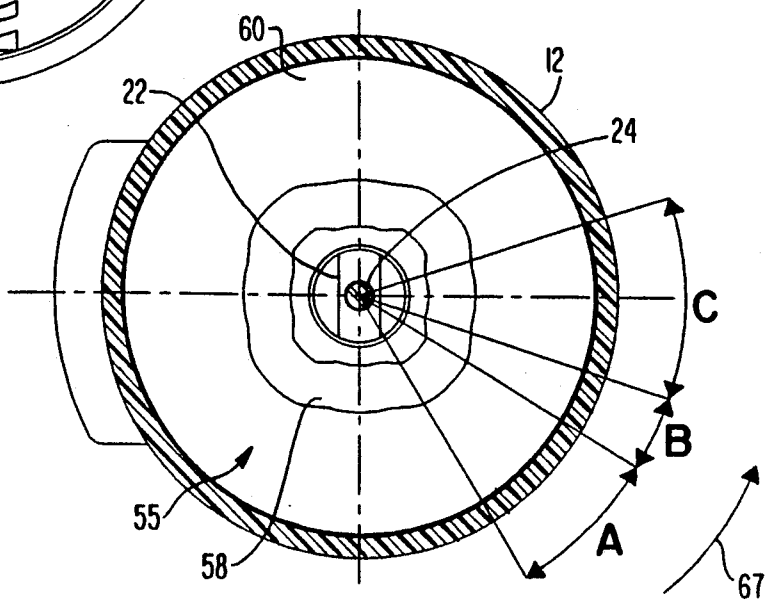
FIG. 5 is a cross-sectional view of the hair removal device taken along section lines V—V of FIG. 1.

As will be understood by examination of FIG. 5, within sectors A and C of its rotation in the direction of arrow 67, rotary head 20 operates with tweezers 32 closed. At the end of rotation through sector A, tweezers 32 are about to open. As rotation continues through sector B, tweezers 32 open when cam follower 62 passes through the portion of groove 58 (FIG. 5) which forces slidable actuator element 45 radially towards the center of rotary head 20. Thus, pivotable elements 34 "flip" and move against the oppositely-facing fixed elements 36, closing against them in sector C. Continued rotation through sector C maintains cam follower 62 radially inward, causing actuator 45 to close tweezers 32.

In accordance with the inventive design, concentric slots 38 are shaped to aid in "combing" the hair during rotation, minimizing the tendency of hairs to slip, and guiding them into spaces 43 wherein they are grasped and plucked. Tweezers 32 approach the hair to be plucked from all directions, by combination of the rotary head 20 rotation and the movement of hair removal device 10 over the skin. This feature of the inventive design insures efficient hair plucking operations.

It is a particular feature of the present invention that cam 55 is designed so as to provide radial movement of slidable actuator 45 in excess of the amount required to close tweezers 32. This allows greater latitude in manufacturing tolerances, and allows for larger amounts of mechanical wear, which increases service life. Additional actuator 45 motion, beyond that required for closing tweezers 32, brings lower edges 52 into contact with lower edges 50 with a force which causes a slight arching of the pivotable elements 34, and this insures tight contact for efficient hair plucking.

When passed over the skin, the multi-tweezer arrangement of rotary head 20 operates each of tweezers 32 simultaneously in a fixed pattern, opening and closing them, so they grasp and pluck skin hair over a wide area. This occurs because individual hairs in a given skin area are trapped by tweezers 32 in spaces 43 during a portion of head 20 rotation, and these hairs are plucked when rotation continues and tweezers 32 close. During continued rotation of rotary head 20, these hairs are released as tweezers 32 open.

In accordance with the principles of the present invention, the rotary head multi-tweezer design is an efficient mechanical design, allowing for cost-effective production and insuring simplicity of use. In addition, the inventive design achieves more plucking operations per rotary head 20 revolution, since at any instant, tweezers 32 may be operated as they are continuously in contact with the skin.

Having described the invention with regard to certain specific embodiments, it is to be understood that the description is not meant as a limitation since further modifications will now suggest themselves to those skilled in the art and it is intended to cover such modifications as fall within the scope of the appended claims.

I claim:

1. A rotary head multiple-tweezer depilatory device comprising in combination:

a housing;

rotary head means comprising a plurality of support channels extending radially, each channel having mounted therein a plurality of tweezers each comprising a fixed element and a pivotably movable element, actuator means slidably seated in each of said channels engaging said pivotably movable elements for operating said tweezers, said rotary head means being arranged to rotate about a shaft seated within said housing substantially perpendicular to an area of skin from which hair is to be removed;

a motor disposed in said housing and being arranged to drive said rotary head means about said shaft; and cam means arranged to cause repetitive, push-pull radial sliding motion of said actuator means synchronous with rotation of said rotary head means about said shaft, such that when placed near the skin, rotation of said rotary head means about said shaft causes each of said tweezers to alternately open and close, trapping skin hair therein when opened and plucking it when closed.

2. The device of claim 1 wherein said rotary head means is in continuous contact with the skin, allowing said tweezers to trap and pluck skin hair at any time during said rotation.

3. The device of claim 1 wherein said rotary head means is disc-shaped and said fixed elements are defined between a plurality of concentric slots formed therein on a lower side thereof, and each of said support channels comprises:

a groove formed radially in said rotary head;

a plurality of notches formed within said groove perpendicular thereto; and a plurality of openings formed, respectively, through a bottom of said groove at intersections of said concentric slots and said groove, said pivotably movable elements extending through said respective openings substantially vertically, and into said concentric slots opposite said fixed elements, defining spaces therebetween.

4. The device of claim 3 wherein said pivotably movable elements are substantially planar in shape, such that during said push-pull radial sliding motion of said actuator means, either side of each pivotably movable element closes against an oppositely-facing one of said fixed elements, providing two-sided hair plucking and increasing the number of hair plucking operations per revolution of said rotary head means.

5. The device of claim 1 wherein said actuator means comprises a notched member extending over and engaging an upper end of each of said pivotably movable elements.

6. The device of claim 1 wherein said cam means comprises a disc-shaped plate formed on a lower side thereof with a groove having a shaped contour, said plate being fixed in said housing, a cam follower attached to said actuator means comprising a pin and roller being engaged within said groove, such that said actuator means follows said contour and develops said radial push-pull sliding motion.

7. A method of removing unwanted skin hair comprising the steps of:

providing a multiple-tweezer hair plucking means coupled to a means of rotational power, said hair plucking means comprising:

rotary head means in which there are formed a plurality of support channels extending radially, each channel having mounted therein a plurality of tweezers each comprising a fixed element and a pivotably movable element, actuator means slidably seated in each of said channels engaging said pivotably movable elements for operating said tweezers, said rotary head means being arranged to rotate about a shaft seated within said housing substantially perpendicular to an area of skin from which hair is to be removed; and cam means arranged to cause repetitive, push-pull radial sliding motion of said actuator means synchronous with rotation of said rotary head means about said shaft; and rotating said multiple-tweezer hair plucking means while it is passed over the skin, sliding motion of said actuator means causing said tweezers to alternately open and close, trapping skin hair therein when opened and plucking it when closed.

8. The method of claim 7 wherein said rotary head means is in continuous contact with the skin, allowing said tweezers to trap and pluck skin hair at any time during said rotation.

9. The method of claim 7 wherein a plurality of concentric slots are formed in said rotary head means between said fixed elements such that during rotation of said rotary head means, said concentric slots provide combing of said skin hair, guiding it within said spaces to insure plucking.

10. The method of claim 9 wherein said combing is multi-directional to insure efficient hair plucking.

11. The method of claim 7 wherein said rotating step is performed by an electrically-powered motor disposed in said housing and arranged to drive said rotary head means.

* * * * *